United States Patent [19]

Cheng et al.

[11] Patent Number: 4,990,903

[45] Date of Patent: Feb. 5, 1991

[54] METHOD FOR STORING CHINESECHARACTER DESCRIPTION INFORMATION IN A CHARACTER GENERATING APPARATUS

[75] Inventors: Kuo-Young Cheng, Taipei; Jen-Tsun Yang, Tainan Hsien, both of Taiwan

[73] Assignee: Bestfont Ltd., St. Helier, Channel Islands

[21] Appl. No.: 89,345

[22] Filed: Aug. 25, 1987

Related U.S. Application Data

[63] Continuation-in-part of Ser. No. 923,311, Oct. 27, 1986, abandoned.

[51] Int. Cl.[5] ..... G09G 5/26

[52] U.S. Cl. ..... 340/731; 340/735; 340/751; 340/790

[58] Field of Search ..... 340/731, 735, 737, 743, 340/751, 790

[56] References Cited

U.S. PATENT DOCUMENTS

| | | | |
|---|---|---|---|
| 4,144,405 | 3/1979 | Wakamatsu | 340/751 |
| 4,181,973 | 1/1980 | Tseng | 340/731 |
| 4,621,340 | 11/1986 | Pokorny et al. | 340/731 |
| 4,670,841 | 6/1987 | Kostopoulos | 340/731 |
| 4,675,830 | 6/1987 | Hawkins | 340/731 |

*Primary Examiner*—Gerald Brigance
*Assistant Examiner*—Richard Hjerpe
*Attorney, Agent, or Firm*—Ladas & Parry

[57] ABSTRACT

A method and apparatus for high resolution character generation using a character generating apparatus having a first central processing unit with memory and input and output devices for processing and outputting character information, and a second central processing unit with different memory units and circuit arrangement electrically coupled with the first central processing unit for receiving character information and outputting processed character data information to produce resultant characters in various forms. The method includes the steps of preparing a character pattern description information for Chinese characters for being input into the character generating apparatus, and constructing a stroke table, a radical table and a specific symbol table for Chinese characters and other language letters for being stored in different memory units of the second central processing unit. Thereby, whenever character information is input, resultant characters can be quickly produced in any resolutions for various applications.

3 Claims, 43 Drawing Sheets

Character Type
Identification Code:" 0 "
A - A': Width Coordinates
B - B': Height Coordinates
| S.O. | Stroke and its related coordinates | Description | Example |
|---|---|---|---|
| 0 | 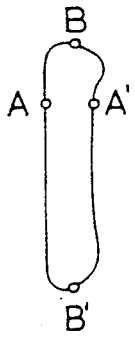  | Upright stroke with both amphasized top and bottom | 中 |
| 1 | 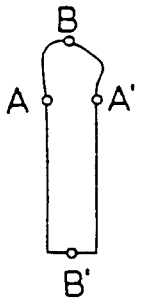  | Upright stroke with a flat bottom | 上 |
| 2 | 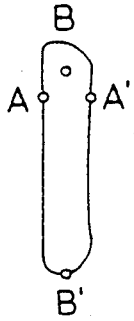  | Upright stroke used for forming left portion of " ┌ ". | □ |
| 3 | 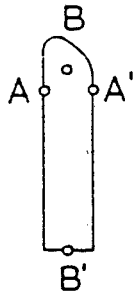  | ditto with flat bottom | 且 |
FIG.3-1

| S.O. | Stroke and its related coordinates | Description | Example |
|---|---|---|---|
| 4 | 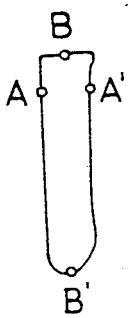 | Upright stroke with a flat top | 示 |
| 5 | 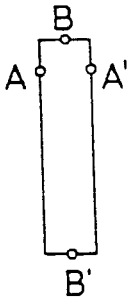 | Upright stroke with a flat top and bottom | 工 |
| 6 | 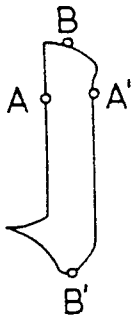 | Hook stroke with emphasized top | 小 |
| 7 | 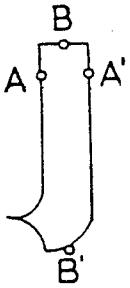 | Hook stroke with flat top | 丁 |
FIG.3-2

| S.O. | Stroke and its related coordinates | Description | Example |
|---|---|---|---|
| 8 |  | horizontal then downward stroke | 已 |
| 9 |  | ditto with flat bottom | 且 |
| 10 |  | horizontal then hook stroke | 川 |
| 11 |  | a down stroke slanting toward the right in about 45° | 人 |

| S.Q. | Stroke and its related coordinates | Description | Example |
|---|---|---|---|
| 12 | 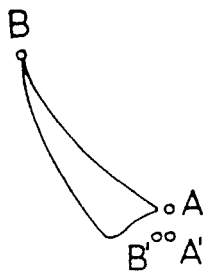 | a down stroke slanting toward the right with relative small angle | 林 |
| 13 | 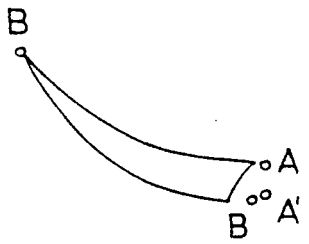 | small curve down stroke slanting to the right | 交 |
| 14 | 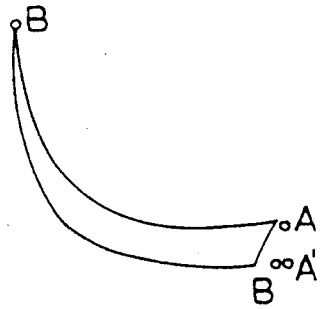 | Large curve down stroke slanting to the right | 爬 |
| 15 | 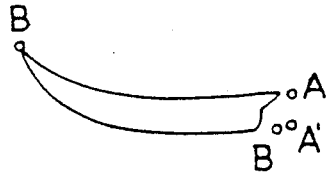 | horizontal stroke with higher left | 建 |
FIG.3-4

| S.O. | Stroke and its related coordinates | Description | Example |
|---|---|---|---|
| 16 | B A A′ B′ | horizontal stroke with emphasized tail | 一 |
| 17 | B B′ | horizontal stroke without tail | 日 |
| 18 | A A′ B′ B | inclination stroke with emphasized tail | 料 |
| 19 | B A A′ B | | 化 |

FIG.3-5

| S.O. | Stroke and its related coordinates | Description | Example |
|---|---|---|---|
| 20 |  | | 已 |
| 21 |  | | 完 |
| 22 |  | | 置 |
| 23 |  | | 匿 |

| S.O. | Stroke and its related coordinates | Description | Example |
|---|---|---|---|
| 24 | 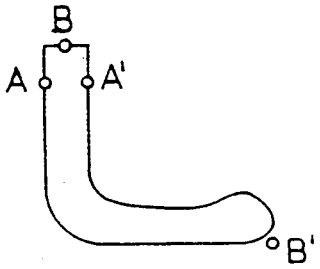 | | 亡 |
| 25 | 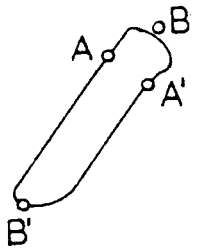 | | 女 |
| 26 | 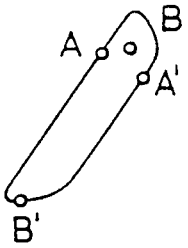 | | 弓 |
| 27 | 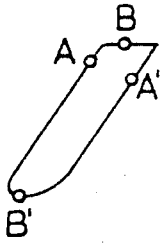 | | 互 |
FIG.3-7

| S.O. | Stroke and its related coordinates | Description | Example |
|---|---|---|---|
| 28 | 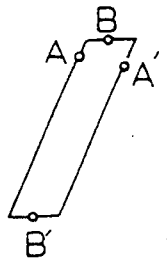 | | 五 |
| 29 | 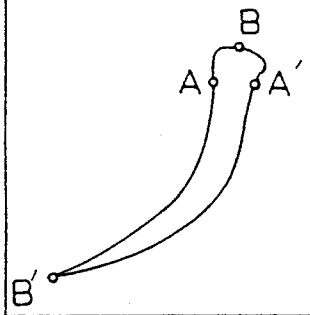 | | 究 |
| 30 | 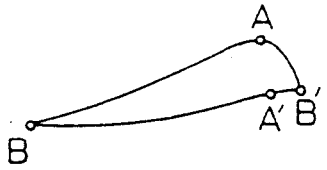 | | 秀 |
| 31 | 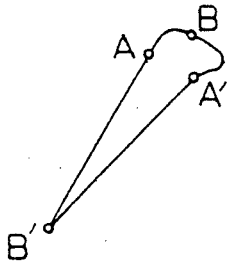 | | 前、礻 |
FIG.3-8

| S.O. | Stroke and its related coordinates | Description | Example |
|---|---|---|---|
| 32 | 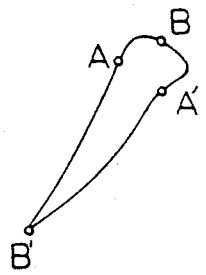 | | 行 |
| 33 | 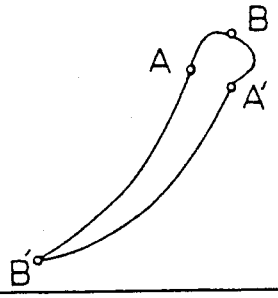 | | 成 |
| 34 | 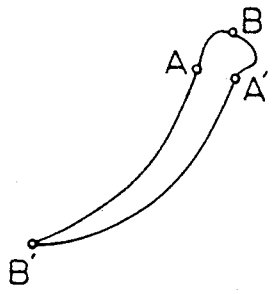 | | 交 |
| 35 | 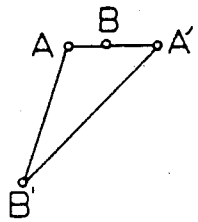 | | 頁 |
FIG.3-9

| S.O. | Stroke and its related coordinates | Description | Example |
|---|---|---|---|
| 36 | 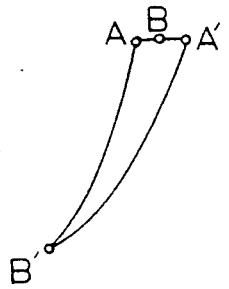 | | 木 |
| 37 | 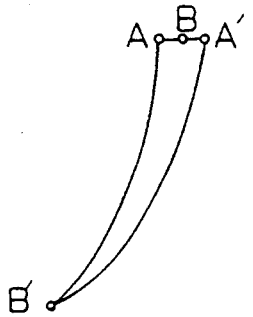 | | 勿 |
| 38 | 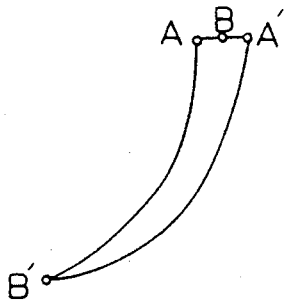 | | 刀 |
| 39 | 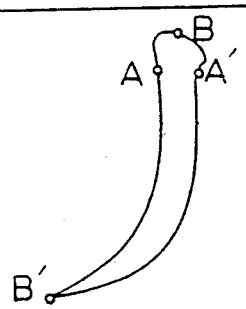 | | 大 |
FIG.3-10

| S.O. | Stroke and its related coordinates | Description | Example |
|---|---|---|---|
| 40 | 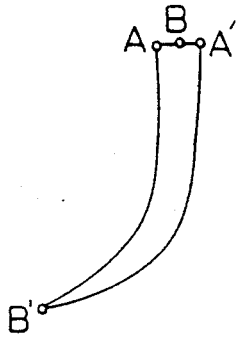 | | 夫 |
| 41 | 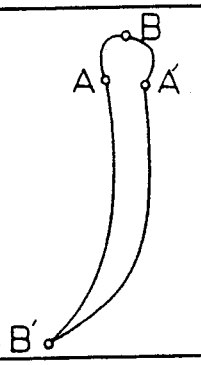 | | 班 |
| 42 | 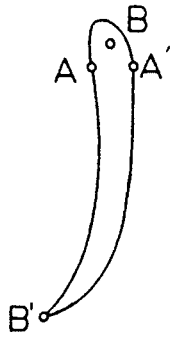 | | 月 |
| 43 | 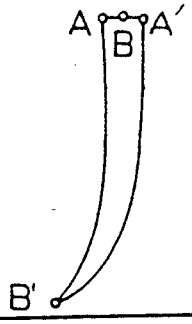 | | 瓶 |
FIG.3-11

| S.O | Stroke and its related coordinates | Description | Example |
|---|---|---|---|
| 44 | 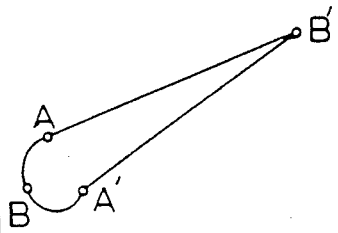 | | 挑 |
| 45 | 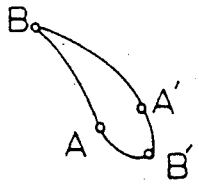 | | 礻 |
| 46 | 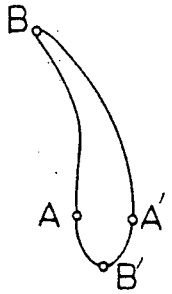 | | 立 |
| 47 | 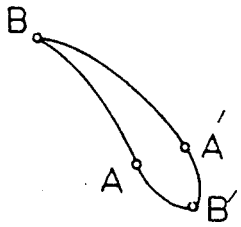 | | 下 |
FIG.3-12

| S.O. | Stroke and its related coordinates | Description | Example |
|---|---|---|---|
| 48 | 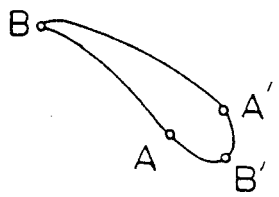 | | 共 |
| 49 | 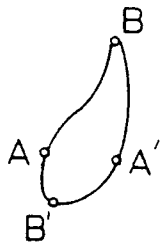 | | 空 |
| 50 | 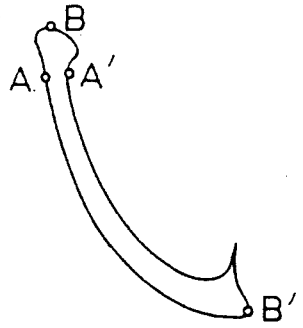 | | 式 |
| 51 | 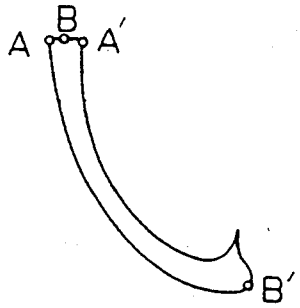 | | 民 |
FIG.3-13

| S.O. | Stroke and its related coordinates | Description | Example |
|---|---|---|---|
| 52 | 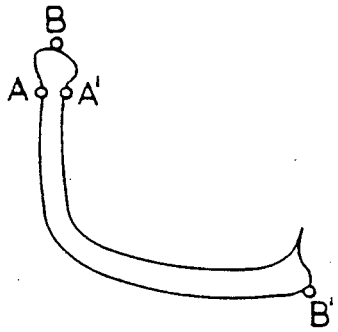 | | 鼬 |
| 53 | 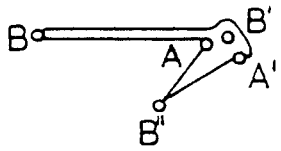 | | 了 |
| 54 | 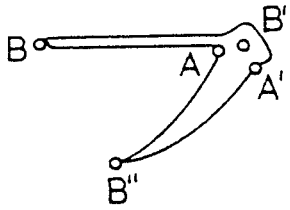 | | 夕 |
| 55 | 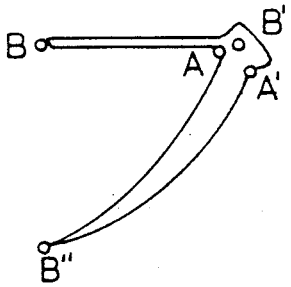 | | 變 |
FIG.3-14

| S.O. | Stroke and its related coordinates | Description | Example |
|---|---|---|---|
| 56 | 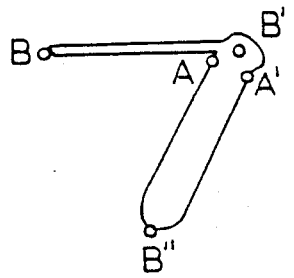 | | 乃 |
| 57 | 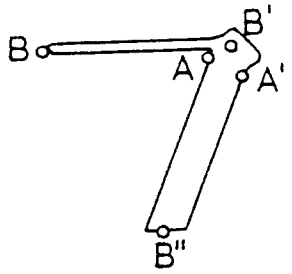 | | 互 |
| 58 | 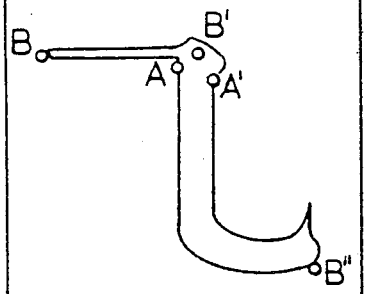 | | 九 |
| 59 | 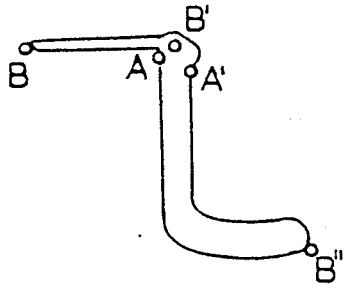 | | 設 |
FIG.3-15

| S.O. | Stroke and its related coordinates | Description | Example |
|---|---|---|---|
| 60 | 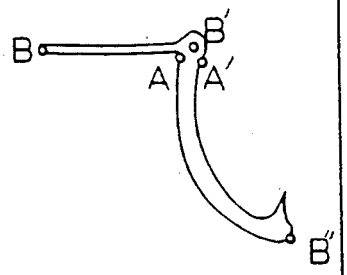 | | 氣 |
| 61 | 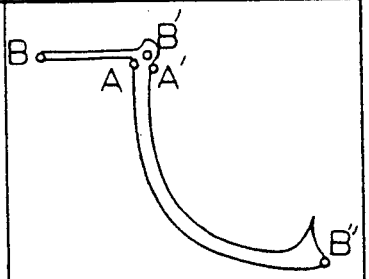 | | 鬲 |
| 62 | 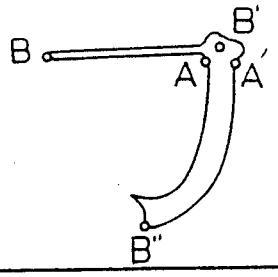 | | 馬 |
| 63 | 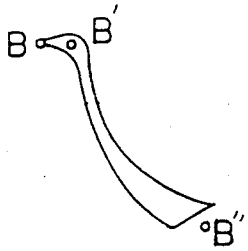 | | 公 |
FIG.3-16

| S.O. | Stroke and its related coordinates | Description | Example |
|---|---|---|---|
| 64 | 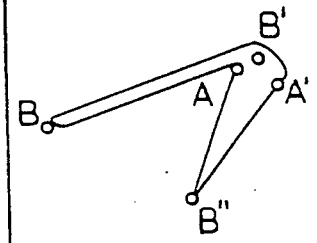 | | 也 |
| 65 | 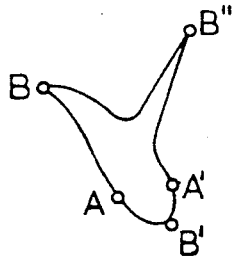 | | 泳 |
| 66 | 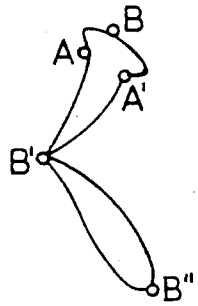 | | 惱 |
| 67 | 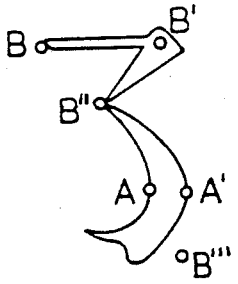 | | 陳 |
FIG.3-17

| S.O. | Stroke and its related coordinates | Description | Example |
|---|---|---|---|
| 68 | 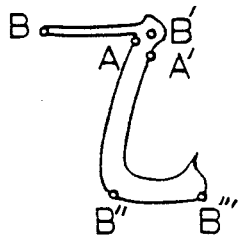 | | 瓦 |
| 69 | 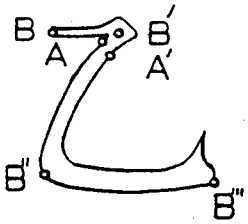 | | 紇 |
| 70 | 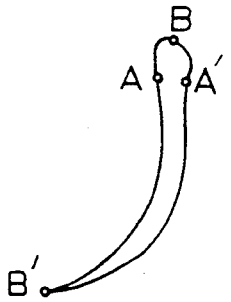 | | 城 |
| 71 | 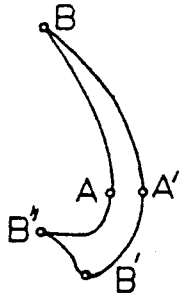 | | 象 |
FIG.3-18

| S.O. | Stroke and its related coordinates | Description | Example |
|---|---|---|---|
| 72 | 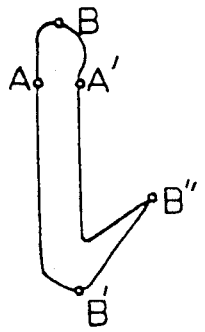 | | 比 |
| 73 | 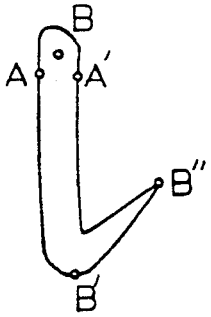 | | 很 |
| 74 | 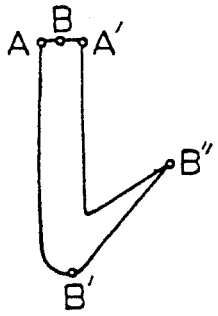 | | 長 |
| 75 | 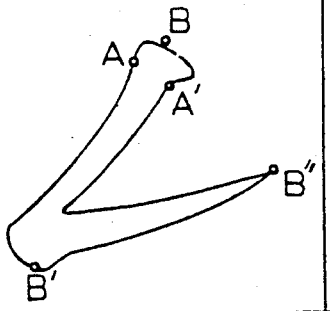 | | 紅 |
FIG.3-19

| S.O. | Stroke and its related coordinates | Description | Example |
|---|---|---|---|
| 76 | 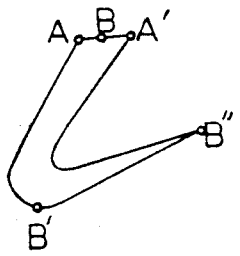 | | 云 |
| 77 | 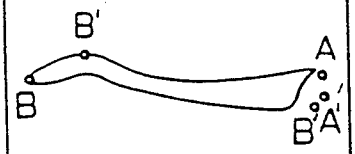 | | 遺 |
| 78 | 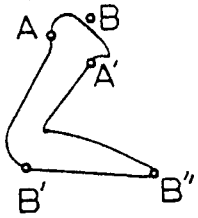 | | 績 |
| | | | |
FIG.3-20

Character Type Identification Code: "0"

BASIC RADICALS

Left Hand Radicals:

Two strokes

0 亻
1 冫
2 匚

Three strokes

3 彳
4 口
5 扌
6 幺
7 辶
8 子
9 巾
0 忄
11 氵
12 扌
13 犭
14 尸

Four strokes

15 女
16 弓
17 山
18 辶
19 方
20 牛
21 火
22 歹
23 日
24 片
25 王
26 木
27 礻
28 月
29 毛
30 月
31 爪

Five strokes

32 禾
33 石
34 目
35 白
36 矛
37 田
38 矢
39 衣

Six strokes

40 耳
41 米
42 虫
43 舟
44 糸
45 缶
46 耒

Seven strokes

47 走
48 酉
49 角
50 貝
51 足
52 糸
53 言
54 車
55 身
56 豸
57 豕

Eight strokes

58 金
59 食
60 韋

Nine strokes

61 革
62 風

Ten strokes

63 馬
64 骨
65 韋
66 鬼

Eleven strokes or more

67 魚
68 黑
69 鼠
70 鼻
71 齒

FIG.4-1

Right Hand Radicals:

Two strokes

72 力
73 刂
74 卩
75 卜
76 丁
77 巳
78 九

Three strokes

79 乞
80 彡
81 干
82 寸
83 夕
84 也
85 乃
86 工
87 千
88 子

Four strokes

89 欠
90 文
91 斤
92 予
93 戈
94 殳
95 今
96 元
97 兂
98 中
99 反
100 月
101 方
102 分
103 巨
104 斗
105 瓦
106 巴
107 爻
108 市
109 勿
110 夫
111 毛
112 丹
113 屯
114 太
115 内
116 殳
117 丑
118 女
119 户
120 介
121 匀
122 夭
123 玄
124 止
125 氏
126 壬
127 及
128 牙
129 支
130 丸
131 文
132 王
133 云
134 允

Five strokes

135 令
136 占
137 由
138 包
139 乍
140 申
141 弗
142 羊
143 田
144 皮
145 召
146 句
147 央
148 且
149 失
150 立
151 平
152 本
153 比
154 必
155 乏
156 丙
157 布
158 卯
159 母
160 目
161 丕
162 末
163 未
164 民
165 旦
166 氏
167 冬

FIG.4-2

Right Hand Radicals:

| | | | | | | | |
|---|---|---|---|---|---|---|---|
| 168 | 它 | 192 | 寺 | 217 | 灰 | 242 | 戎 |
| 169 | 缶 | 193 | 聿 | 218 | 圭 | 243 | 存 |
| 170 | 石 | 194 | 旬 | 219 | 回 | 244 | 而 |
| 171 | 尼 | 195 | 舌 | 220 | 有 | 245 | 耳 |
| 172 | 用 | 196 | 同 | 221 | 亘 | 246 | 因 |
| 173 | 夕 | 197 | 合 | 222 | 光 | 247 | 危 |
| 174 | 甘 | 198 | 羽 | 223 | 匡 | 248 | 奴 |
| 175 | 乎 | 199 | 百 | 224 | 共 | Seven Strokes | |
| 176 | 引 | 200 | 并 | 225 | 交 | 249 | 阝 |
| 177 | 加 | 201 | 色 | 226 | 夆 | 250 | 肖 |
| 178 | 甲 | 202 | 辰 | 227 | 全 | 251 | 甫 |
| 179 | 世 | 203 | 牟 | 228 | 劦 | 252 | 見 |
| 180 | 只 | 204 | 朱 | 229 | 曳 | 253 | 夆 |
| 181 | 正 | 205 | 名 | 230 | 休 | 254 | 孚 |
| 182 | 主 | 206 | 台 | 231 | 先 | 255 | 受 |
| 183 | 宁 | 207 | 吊 | 232 | 向 | 256 | 夾 |
| 184 | 册 | 208 | 朵 | 233 | 血 | 257 | 亥 |
| 185 | 生 | 209 | 兆 | 234 | 旨 | 258 | 余 |
| 186 | 冉 | 210 | 年 | 235 | 至 | 259 | 兌 |
| 187 | 司 | 211 | 老 | 236 | 舟 | 260 | 巠 |
| 188 | 幼 | 212 | 列 | 237 | 州 | 261 | 里 |
| 189 | 左 | 213 | 各 | 238 | 朱 | 262 | 更 |
| 190 | 右 | 214 | 后 | 239 | 匠 | 263 | 孛 |
| Six strokes | | 215 | 艮 | 240 | 成 | 264 | 呆 |
| 191 | 羊 | 216 | 瓜 | 241 | 式 | 265 | 邦 |

FIG.4-3

266 麦
267 邑
268 步
269 風
270 每
271 帛
272 豆
273 朵
274 廷
275 妾
276 甬
277 良
278 麦
279 利
280 瓦
281 呂
282 告
283 含
284 旱
285 谷
286 完
287 困
288 宏
289 局
290 月
291 君
292 爻
293 希
294 糸
295 矛
296 辛
297 匈
298 志
299 辰
300 星
301 出
302 串
303 岑
304 生
305 東
306 我
307 吾
308 尾

Eight strokes

309 音
310 表
311 朋
312 並
313 昔
314 孟
315 昏
316 弟
317 周
318 典
319 定
320 東
321 沓
322 匈
323 炎
324 采
325 尚
326 延
327 垂
328 隹
329 兒
330 念
331 來
332 奈
333 赤
334 望
335 戾
336 京
337 兩
338 奎
339 侖
340 虎
341 花
342 夸
343 奇
344 亥
345 青
346 爭
347 居
348 匊
349 卷
350 妻
351 其
352 求
353 辛
354 直
355 忽
356 屈
357 具
358 差
359 者
360 帚

FIG.4-4

361 卓
362 寻
363 長
364 癸
365 承
366 昌
367 叔
368 享
369 舍
370 甾
371 取
372 辛
373 宗
374 糸
375 松
376 厓
377 奄
378 宜
379 夜
380 易
381 亞
382 肴
383 武
384 委
385 宛
386 罔
387 育
388 或
389 永
390 走
391 果

Nine strokes

392 東
393 禹
394 扁
395 卑
396 是
397 美
398 奥
399 昜
400 星
401 彖
402 复
403 重
404 耳
405 皇
406 甾
407 俞
408 頁
409 保
410 奔
411 奉
412 面
413 眉
414 某
415 美
416 冒
417 苗
418 屏
419 面
420 風
421 帝
422 茉
423 帶
424 度
425 段
426 盾
427 泰
428 炭
429 亭
430 南
431 奕
432 郎
433 亮
434 昜
435 侯
436 函
437 咸
438 胡
439 岡
440 軍
441 為
442 昆
443 司
444 段
445 建
446 姜
447 禹
448 秋
449 酋
450 杳
451 相
452 胥
453 宣
454 查
455 貞

FIG.4-5

456 青
457 飛
458 甚
459 扇
460 柔
461 茲
462 奏
463 恕
464 思
465 咢
466 音
467 耶
468 要
469 垂
470 匽
471 彥
472 英
473 盈
474 屋
475 畏
476 戚
477 胃
478 畐
479
480 勇
481 面
Ten strokes
482 真
483 鬼
484 員
485 皆
486 毒
487 倉
488 貞
489 盍
490 崔
491 旁
492 兼
493 臼
494 專
495 莆
496 冥
497 荅
498 鳥
499 彖
500 翦
501 唐
502 辱
503
504 辰
505 采
506 留
507 高
508 臬
509 桀
510 晁
511 貢
512 堇
513 晉
514 秦
515 奚
516 息
517 窄
518 袁
519 茶
520 臼
521 匆
522 殺
523 翔
524 答
525 茸
526 草
527 蚤
528 叟
529 桑
530 素
531 宗
532 益
533 岸
534 恩
535 盟
536 韋
537 翁
Eleven strokes
538 莫
539 責

FIG.4-6

540 曹
541 曼
542 冊
543 習
544 專
545 庸
546 章
547 崩
548 畢
549 票
550 鳥
551 商
552 堂
553 累
554 婁
555 离
556 翼
557 逵
558 鹵
559 鹿
560 虖
561 基
562 寄
563 祭
564 喬
565 堅
566 將
567 竟
568 戚
569 虛
570 雪
571 產
572 參
573 常
574 易
575 商
576 爽
577 息
578 從
579 崔
580 敖
581 區
582 寅

Twelve strokes

583 棄
584 業
585 貫
586 堯
587 單
588 番
589 普
590 無
591 隶
592 畢
593 登
594 敦
595 貴
596 童
597 舞
598 勞
599 量
600 華
601 會
602 惠
603 黃
604 幾
605 焦
606 景
607 爾
608 強
609 犀
610 喜
611 象
612 尋
613 戠
614 奚
615 敢
616 朝
617 善
618 舜
619 閏
620 曾
621 尊

FIG.4-7

622 斯
623 壹
624 欬
625 粤
626 雲

Thirteen strokes

627 蜀
628 金
629 畢
630 粟
631 豊
632 輿
633 發
634 亶
635 達
636 詹
637 當
638 戟
639 雷
640
641 廉
642 虜
643 莫
644 歲
645 晨
646 敦
647 畫
648 晉
649 篤
650 解
651 楚
652 數
653 變
654 慈
655 粲
656 塞
657 遣
658 遂
659 愛
660 義
661 意
662 業
663 葉
664 廻

Fourteen strokes

665 農
666 賓
667 蒙
668 壽
669 肅
670 雨
671 帝
672 疑
673 寧
674 監
675 閣
676 豪
677 蔑
678 魁
679 齊
680 夏
681 熏
682 榮
683 蒼
684 聲
685 瞿
686 急

Fifteen strokes

687 麥
688 亂
689 樂
690 厲
691 寮
692 魯
693 慧
694 廣
695 憂
696 雍

Sixteen strokes

697 養
698 頼
699 歷
700 盧
701 龍

FIG.4-8

702 鼻
703 鼎
704 燕
Seventeen or more strokes
705 襄
706 閑
707 爵
708 嬰
709 纖
710 霜
711 豐
712 聶
713 雚
714 舊
715 藏
716 羅
717 義
718 叢
719 黨
720 覽
721 蕭
722 屬
723 鹿
724 既

FIG.4-9

| Top Radicals | | Optional Radicals | | Bottom Radicals | |
|---|---|---|---|---|---|
| 725 | 冂 | 758 | 宀(上) | 744 | 又 |
| 726 | 口(右) | 759 | 女(下) | 745 | 土 |
| 727 | 宀 | 760 | 火(〃) | 746 | 山 |
| 728 | 广 | 761 | 可(右) | 747 | 心 |
| 729 | 艹 | 762 | 宀(上) | 748 | 灬 |
| 730 | 山 | 763 | 日(下) | 749 | 木 |
| 731 | 四 | | | 750 | 手 |
| 732 | 疒 | | | 751 | 皿 |
| 733 | 灬 | | | 752 | 虫 |
| 734 | 卢 | | | 753 | 衣 |
| 735 | 疔 | | | 754 | 貝 |
| 736 | 毋 | | | 755 | 金 |
| 737 | 非 | | | 756 | 門 |
| 738 | 攵 | | | 757 | 臣 |
| 739 | 彡 | | | | |
| 740 | 鳥 | | | | |
| 741 | 敝 | | | | |
| 742 | 癶 | | | | |
| 743 | 鳥 | | | | |

FIG.4-10

Address: 6639

Radicals: 18 辶

| | | |
|---|---|---|
| a' | 45 | 丶 |
| b' | 56 | 亠 |
| c' | 54 | 丿 |
| d' | 77 | 一 |

Strokes:

| | | |
|---|---|---|
| 1 | 53 | 乀 |
| 2 | 47 | 丶 |
| 3 | 2 | 丨 |
| 4 | 10 | 亅 |
| 5 | 17 | 一 |
| 6 | 17 | 一 |
| 7 | 4 | 丨 |

470x470

ABCDEFGHIJ
KLMNOPQRS
TUVWXYZ
abcdefghij
klmnopqrs
tuvwxyz

ABCDEFGHIJ
KLMNOPQRS
TUVWXYZ
abcdefghij
klmnopqrs
tuvwxyz

100x100
Jampe

100x100
Kunst

200x200
Jampe

200x200
Kunst

250x250
Jampe

250x250
Kunst

FIG.6-3

FIG.6-4

24x24

あいうえお　さしすせそ
かきくけこ　たちつてと
なにぬねの　まみむめも
はひふへほ　やゆよらり
るれろわを　ん

48x48

あいうえお　さしすせそ
かきくけこ　たちつてと
なにぬねの　まみむめも
はひふへほ　やゆよらり
るれろわを　ん

80x80

あいうえお　さしすせそ
かきくけこ　たちつてと
なにぬねの　まみむめも
はひふへほ　やゆよらり
るれろわを　ん

127x127

あいうえお　さしすせそ
かきくけこ　たちつてと
なにぬねの　まみむめも
はひふへほ　やゆよらり
るれろわを　ん

FIG. 6-5

日文變化

あいうえお
かきくけこ
さしすせそ
たちつてと
なにぬねの
はひふへほ
まみむめも
やゆよらり
るれろわを
ん

あいうえお　はひふへほ
かきくけこ　まみむめも
さしすせそ　やゆよらり
たちつてと　るれろわを
なにぬねの　ん

FIG.6-6

100x100

외 과 의

200x200

외 과 의

250x250

외 과 의

FIG.6-7

100x100

ШКАФ

200x200

ШКАФ

250x250

ШКАФ

FIG.6-8

100x100

Computar

200x200

Computar

250x250

Computar

FIG.6-9

50x50
の G

70x70
の G

100x100
の G

200x200
の G

300x300
の G

100x100
神 通

150x150
神 通

200x200
神 通

250x250
神 通

FIG.7-1

480x480
の G

FIG.7-2

METHOD FOR STORING CHINESECHARACTER DESCRIPTION INFORMATION IN A CHARACTER GENERATING APPARATUS

BACKGROUND OF THE INVENTION

This application is a continuation-in-part of application Ser. No. 923,311 filed Oct. 27, 1986, now abandoned.

This invention relates to a method and apparatus for generating characters, and more particularly to a method and apparatus by which various kinds of character description data are stored in a memory system of a character generating apparatus through different data tables and identification values which are treated and processed for producing characters of high resolution with different sizes and patterns for various applications.

Conventional character generators used in a personal computer usually employ a dot matrix pattern. It is understood by those skilled in the computer field that the conventional dot-matrix character generators suffer several problems and disadvantages such as:

(1) The memory used for storing the character dot matrix is determined by the order of the matrix with the following equation: number of bytes $=n^2/8$ wherein "n" is the order of the dot matrix. When $n=16$, each character will use 32 bytes in a memory, and when $n=24$, each character will occupy 72 bytes in the memory. It is known that in consideration of a memory capacity, characters adopting $16\times16$ or $24\times24$ dot matrix pattern are almost at the extreme limit of that which can be practiced. Therefore, the size of each character and the memory space are all confined in the dot matrix pattern, and no optional processing operation can be performed.

(2) In a dot matrix pattern of conventional character generators, it is not economic to enlarge the generated character by increasing the order of the dot matrix because, in doing this, the memory space has to be greatly expanded for meeting the required enlargement. In another aspect, if a $16\times16$ or a $24\times24$ dot matrix character is enlarged, the resulting character will not have a smooth contour and will appear to be more like a sawtooth figure, lacking aesthetic quality.

(3) In the conventional dot matrix pattern, it is usually not possible to change the character into an asymmetric pattern such as a $16\times24$ dot matrix pattern. Even if it is achieved by special technology, the time required for generating a single character would be very long and also memory capacity required for each character would be very large.

(4) When using a conventional dot matrix as stated above to process characters and graphical patterns simultaneously, and especially in processing high resolution graphical patterns at the same time as relatively low resolution characters, extra hardware and software must be introduced into the system for enabling the matching between the characters and the graphs. This not only increases the complexity and inconvenience but also slows down the speed of the process for generating the resulting characters and graphs either directly on a CRT or through a printer.

(5) Since information processing has been so extensively developed, there is a necessity to store different kinds of information in different characters for processing in the same system. Unfortunately, different characters such as Arabic, Chinese, English, Korean, Japanese, etc., often present difficulties when being treated by the same processing system. For example, Chinese calligraphy is a traditional culture which has been practiced and practiced by Chinese people over many centuries. In preparing and processing data for Chinese characters, it is very common to use different kinds of Chinese calligraphy such as "text-hand", "running-hand", "cursive-hand", "seal-type" (a kind of Chinese calligraphy specifically used for carving seals and chops), "Sung-type" (a kind of printing type used in books and newspapers), etc. Unfortunately, however, Chinese characters when stored and processed in a computer system are usually confined within a fixed limit and no variation in character pattern can be achieved.

SUMMARY OF THE INVENTION

It is accordingly a primary object of this invention to provide a method and apparatus for character generation of high resolution so as to create variable characters which can vary in size, thickness, etc., without distorting the basic form of the characters.

It is another object of this invention to provide a method and apparatus for generating characters of high resolution through which characters in different calligraphics such as "text-hand", "running hand", "seal-type", "Sung-type", etc., and also in different models such as slim strokes and boldfaced strokes, can be produced accordingly.

It is a further object of this invention to provide a method and apparatus for generating characters of high resolution through which various symbols, different alphabets and Chinese cursive-style characters can be produced.

It is a still further object of this invention to provide a method and apparatus for generating characters of high resolution by which the generated characters having the nature of dot matrix will be stored or displayed through a high resolution output device while the generated characters having a nature of vector can be directly output through a high resolution plotting device.

It is a still further object of this invention to provide a method and apparatus for generating characters in high resolution in which each stored character occupies a definite memory space without incurring any expansion therein no matter how the pattern, size or model of the character is to be changed during character generating operations.

These and other objects are achieved by providing a method and apparatus for generating characters in any resolutions (low to high) wherein the method comprises the steps of: (1) constructing a stroke table for Chinese characters according to the character script style such as "text-hand", "running-hand", "seal-type", "Sung-type", etc., and designating each stroke with a stroke code and stroke description information for being stored in a stroke memory of a character generating apparatus according to this invention; (2) preparing a specific symbol table for cursive-style Chinese characters and other language letters such as Arabian, English, Japanese, Korean, etc., as well as some special symbols such as ㄱ, ✦, etc., and designating each of the specific symbols with a specific symbol code and variation parameter information for being stored in a specific symbol memory of the character generating apparatus; (3) constructing a radical table for Chinese characters according to the common radicals or Chinese alphabet, and assign each radical a radical code to represent stroke codes, which construct that radical, for being stored in a radical table memory of the character generating apparatus; (4) preparing a character pattern description table (here the word "pattern" can be referred to any written styles of the Chinese characters, but hereinafter the "pattern" means a standard written style of Chinese characters in this invention) based on the stroke table and the radical table for Chinese characters, and each entry in this table is the description of strokes and radicals, which construct that pattern, with description information provided for being input into the character generating apparatus; and (5) defining a set of an identification value for the variation parameters of the strokes and radicals of the Chinese characters for being input ino the character generating apparatus in producing the resultant characters. The character generating apparatus according to this invention comprises: a first central processing unit having input means and memory means functionally connected thereto for processing and outputting the character code, variation parameters and identification values therefrom; and a second central processing unit combined of memory means, stroke generating means, curve generating means and contour blackening means functionally coupled with the first central processing unit for storing and processing character description information and outputting the resulting characters in any resolutions through an output device coupled with both the first and second central processing units.

Other advantages and characteristics of this invention will become clear from the following detailed description of a preferred embodiment when read in conjunction with the accompanying drawings.

BRIEF DESCRIPTION OF THE DRAWINGS

FIGS. 3-1 to 3-20 are representations showing one set of stroke tables in "Sung-type" with a character type "0" according to this invention;

FIG. 4 is a representation of a specific symbol table according to this invention;

FIGS. 4-1 to 4-10 are representation showing one set of radical tables also in "Sung-type" with a character type "0" according to this invention;

FIG. 5 is a drawing showing representations of a Chinese character "通" with the character address, radical codes and stroke codes;

FIG. 6 is a drawing showing representations of a Chinese character "通" different dimensions;

FIGS. 6-1 to 6-9 are representations showing an example of various language letters produced in various dimensions according to this invention;

FIG. 7-1 is a drawing showing a representation of Chinese characters "清" and "通" in the type of cursive-hand; and FIG. 7-2 ia a drawing showing a representation of an English letter "G" and a Japanese character "の" according to this invention.

DETAILED DESCRIPTION OF THE PREFERRED EMBODIMENT

Figure 1:
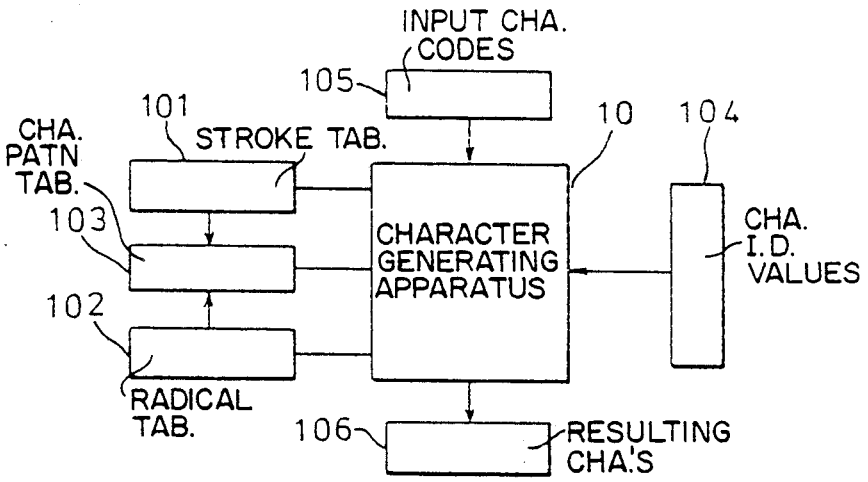
FIG. 1 is a block diagram illustrating the method and apparatus for high resolution character generation according to this invention.

Referring to FIGS. 1, there is depicted a block diagram illustrating the method and apparatus for high resolution character generation according to this invention. The method comprises the steps of constructing and storing a stroke table (as represented by the block 101), constructing and storing a radical table (represented by the block 102), preparing and storing a character pattern description table (represented by the block 103), inputting character codes (represented by block 105), and character identification values (represented by block 104) into a character generating apparatus 10 for processing, so that resulting characters 106 are produced accordingly.

Figure 2:
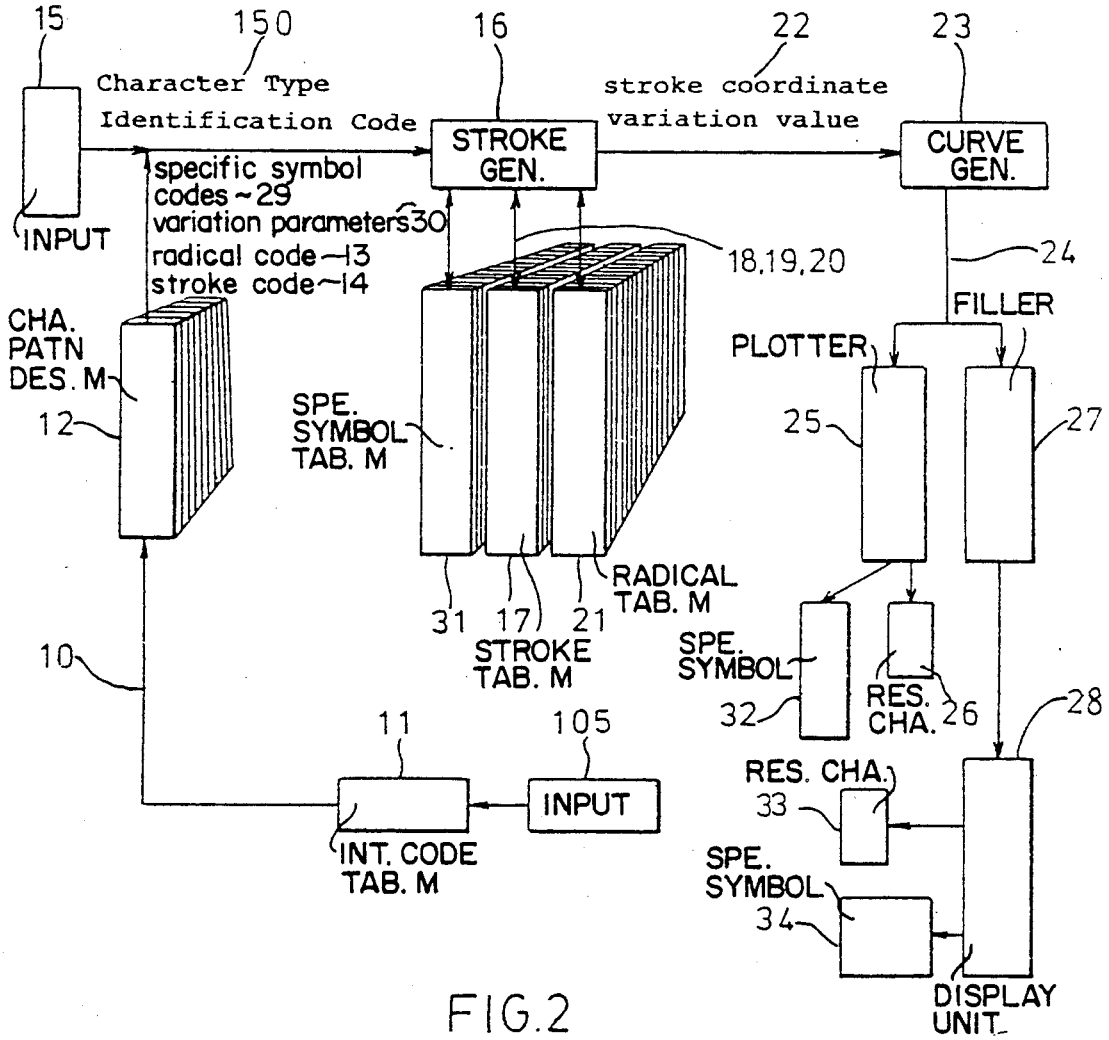
FIG. 2 is an illustrative block diagram indicating a preferred embodiment of a character generating apparatus for executing the method of this invention.
Figure 2A:
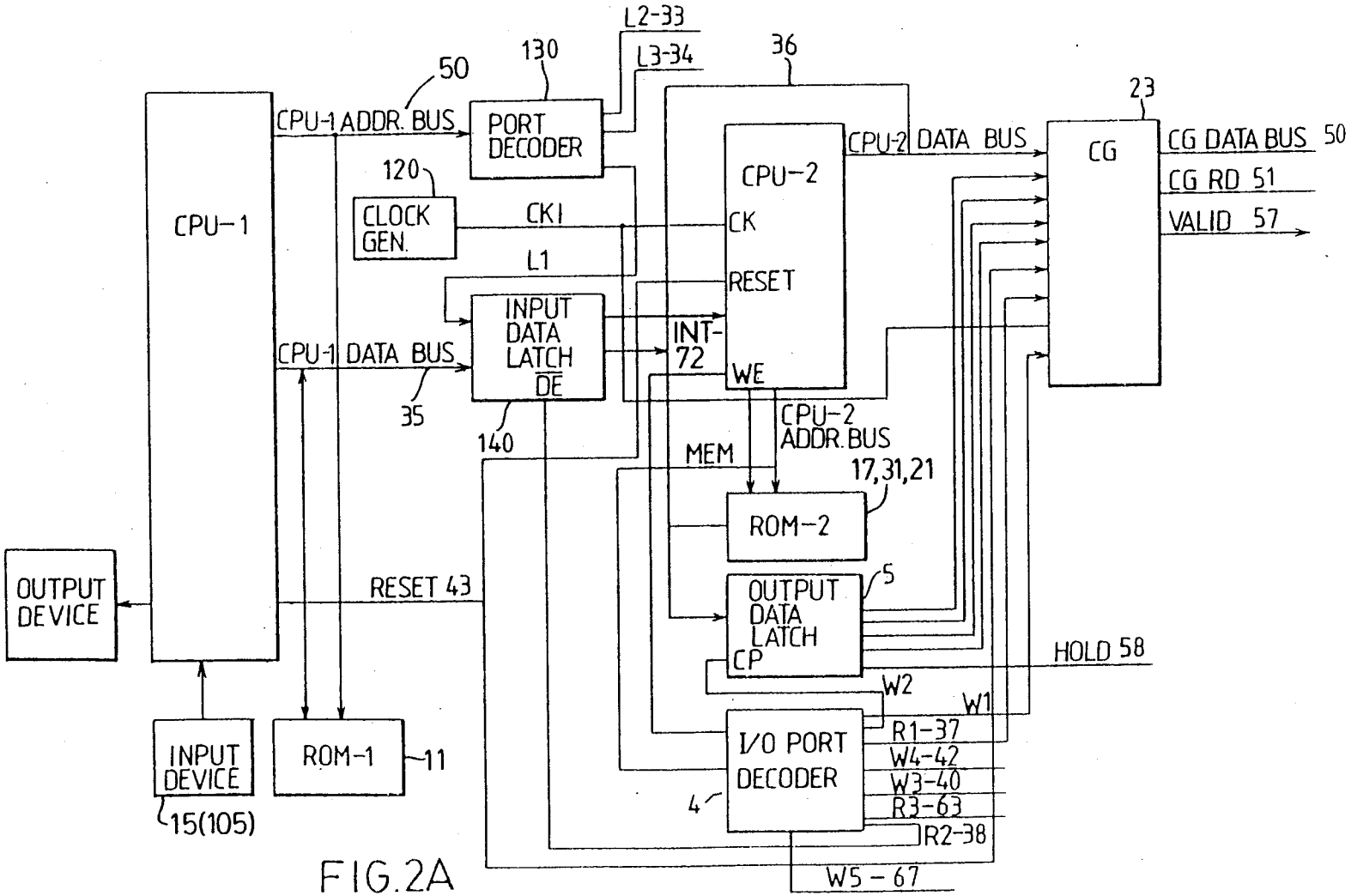
FIG. 2A is a partial circuit diagram of the preferred embodiment of the character generating apparatus shown in FIG. 2.
Figure 2B:
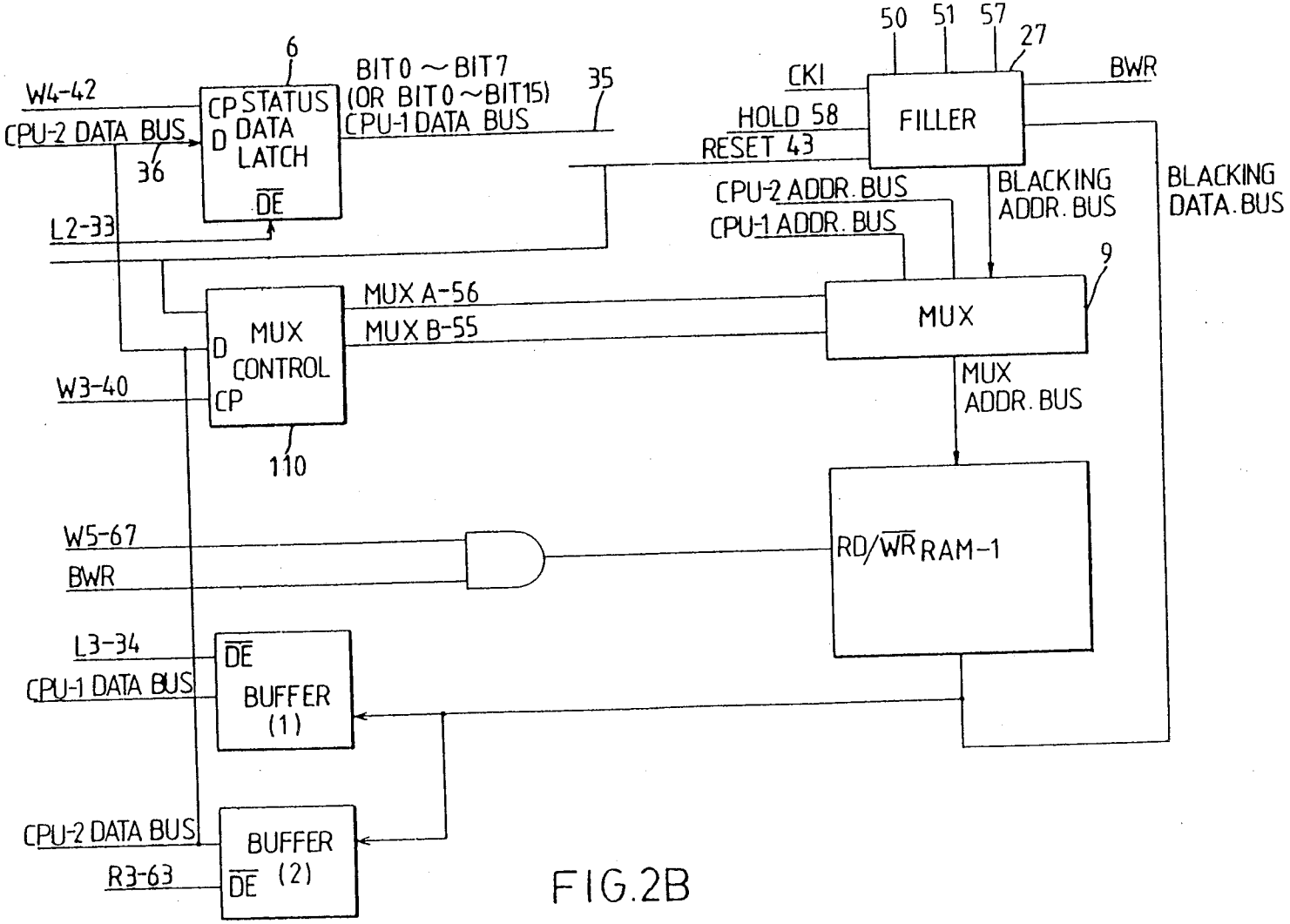
FIG. 2B is a another partial circuit diagram of the preferred embodiment of the character generating apparatus shown in FIG. 2.
Figure 3:
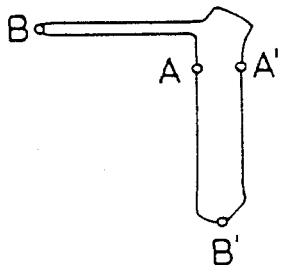
Figure 3:
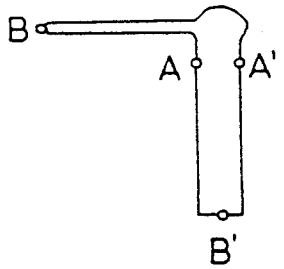
Figure 3:
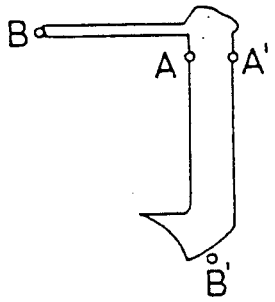
Figure 3:
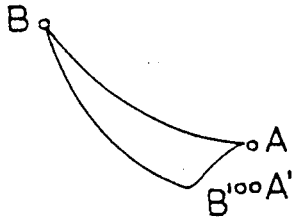
Figure 3:
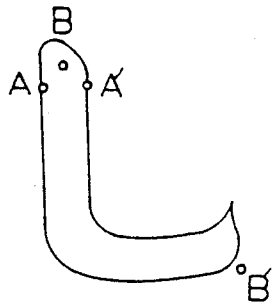

Referring to FIGS. 2, 2A and 2B, there is shown a preferred embodiment of the character generating apparatus according to this invention, which apparatus comprises a character generating apparatus 10 mainly composed of a first central processing unit CPU-1 and a second central processing unit CPU-2, together with their functionally associated units, as shown in FIGS. 2A and 2B. The CPU-1 and its associated units include input means 15, 105 functionally coupled to the CPU-1 for inputting a character internal code through input means 105 and a character type code and identification value through input means 15, as shown in FIG. 2; an address bus 50 and a data bus 35 connected to the CPU-1 through a port decoder 130 and an input data latch 140, and an output device including a high resolution plotter 25 and a high resolution display unit 28 respectively coupled with CPU-1 and CPU-2 for producing resulting characters and specific symbols 33, 34 in dot matrix through filler 27 and display unit 28 as well as resulting characters and specific symbols 26, 32 in vector value through plotter 25. In addition, port decoder 130 is used to decode the address bus of CPU-1 into control signals L1, L2, L3, for controlling data transfer between CPU-1 and CPU-2.

The CPU-2 and its associated units include: a stroke generator 16, a ROM-1 (which is also identified as an internal code table memory 11) for storing an "internal code table" of Chinese characters or characters of other languages such as English, Japanese, Korean, etc. (wherein the "internal code table" is conventional and normally adopted by computer manufacturers for storing the Chinese characters or other language characters in an internal memory system, and therefore a detailed description is hereby omitted), a character pattern description memory 12; a ROM-2 divided into a stroke table memory 17 for storing stroke description information of Chinese characters, a radical table memory 21 for storing radical codes and stroke codes constructing each radical, and a specific symbol table memory 31 for storing various specific symbol codes for cursive Chinese characters and other language letters, identification values and variation parameters of Chinese characters and other language letters as shown in FIG. 2; a curve generator (CG) 23 connected to stroke generator 16 for converting the stroke coordinate variation values 22 of all stroke contour coordinates received from stroke generator 16 into stroke contour coordinates (or stroke contour vector values) 24 of character strokes and contours; a filler 27 coupled with curve generator 23 for blackening the contours coordinates received from curve generator 23 and transferring the blackened information therefrom; a RAM-1 connected to filler 27 and CPU-2 for temporarily storing information received from both the filler 27 and the curve generator 23 for the processed character radicals and strokes; a clock generator 120 coupled to the CPU-2 for providing the CPU-2, CG 23 and filler 27 with required clock signals; an output data latch 5 coupled with the CPU-2 and the CG 23 for temporarily storing the set character parameters transferred from the CPU-2 and determine the operation status of the CG 23; an input/output port decoder 4 connected to the CPU-2 for decoding the address information transferred from the CPU-2 into various I/0 control signals (R1-37, R2-38, R3-63, W1, W2, W3-40, W4-42, W5-67); a second output data latch 6 connected between the CPU-1 and CPU-2 for temporarily storing various handshaking signals from the CPU-2 to CPU-1; a multiplexer control 110 connected to the CPU-2 for generating control signals MUXA-56 and MUXB-55 therefrom based upon the input signals from CPU-2; and a multiplexer 9 coupled with the filler 27, the RAM-1 and the multiplexer control 110 for determining which one of the three units—the CPU-1, CPU-2 and the filler 27 can retrieve the information from the RAM-1.

Referring to FIGS. 2, 3-1 to 3-20, 4, 4-1 to 4-10, 5, 6, 6-1 to 6-9, and 7-1 to 7-2, the method for high resolution character generation according to this invention comprises the steps of:

(1) Constructing a stroke table for Chinese characters will now be explained with reference to FIGS. 3-1 to 3-20. There are many kinds of Chinese calligraphy such as text-hand, running-hand, seal-type (used for carving seals and chops), Sung-type (a kind of printing type as used in newspapers and books), etc., in standard written forms and slim strokes, thick and bulky strokes, cursive strokes, etc., in non-standard written style. However, no matter how the Chinese characters change in their written forms and style, each Chinese character is basically formed by several strokes. One set of the strokes is shown in FIGS. 3-1 to 3-20 wherein all the basic strokes belong to Sung-type characters, and are designated with a character type identification code "0" as shown on the upper left corner in FIG. 3-1. All Sung-type characters are classified into seventy nine basic strokes which are systematically arranged in the stroke table with each one of them being assigned with a stroke code from 0 to 78 as respectively shown in the left stroke columns of FIGS. 3-1 to 3-20. Moreover, in order to define the exact stroke form, each stroke is further defined by several control points with width control points A, A' to control the width of each stroke, and profile control points B, B' to control and define the length and position of each stroke in one character. The character type identification code "0", the stroke codes (0–78) together with the coordinates derived from the strokes control points A, A'; B, B'; and other marks (not shown), are systematically stored in the stroke table memory 17 through a software program (not attached herewith).

Shown in FIGS. 3-1 to 3-20 are the strokes of the Sung-type characters. It shall be appreciated that there can be another set of strokes for text-hand characters, seal-type characters, etc., and the coordinates of the strokes for different type of Chinese characters are all stored in the stroke memory 17. In FIGS. 3-1 to 3-5, the nature of strokes from stroke codes "0" to "18" is explained in the "Description" column and an example of the corresponding Chinese character formed with the specified strokes is shown in the "Example" column. For example, the stroke designated with a stroke code "0" is an upright stroke with complete top and bottom, which is written as a central stoke such as that formed in a Chinese character "中", The stroke code "6" for another example, is a hook stroke with a complete top in forming a central portion of a Chinese character such as "小".

Figure 4:
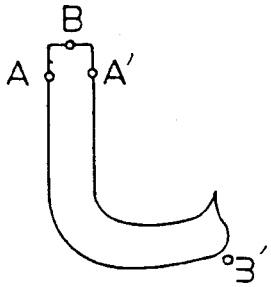

(2). Preparing a specific symbol table as shown in FIG. 4 for cursive-type Chinese characters and other language letters such as Arabian, English, French, German, Japanese, Korean, Russian, Spanish, etc., as well as some special symbols such as "コ", "★", etc. will now be described. Since there is no basic stroke defined for the cursive-type characters and other language letters and special symbols, it is preferable to use specific symbols for character generating operations. The specific symbol table is also prepared in the same way as that made for the stroke table described in (1) above. Each specific symbol, as shown in FIG. 4, is assigned with a symbol code, and each symbol is defined by a plurality of key points, and then, the symbol code and the coordinates of all the specific symbols are systematically stored in the specific symbol memory 31, as shown in FIG. 2, through a software program (not attached herewith).

(3). Constructing a character radical table as respectively shown in FIGS. 4-1 to 4-10 will now be explained. Although Chinese characters in written form can be defined with strokes, many of the characters have a common substructure of strokes forming a radical. It is therefore preferable to provide a character radical table to speed up the generation of Chinese characters. Again, in constructing the character radical table, the Sung-type characters are also adopted as a standard form, and character type identification code "0" is assigned for it as shown on the upper left of FIG. 4-1. As shown in the character radical table, there are four kinds of radicals defined for the Sung-type characters based on the occurence of the radicals written in characters, such as left hand radicals shown in FIG. 4-1; right hand radicals shown in FIGS. 4-2 to 4-9; top radicals, and bottom radicals in FIG. 4-10. In addition, there are six top radicals marked with "R" (for right), "B" (for bottom), and "T" (for top), as shown in FIG. 4-10, serving as optional radicals which can be used in different positions depending on the necessary occurence of the radicals in characters. Each kind of radicals is further defined with regard to stroke number, such as a two stroke radical, three stroke radical, etc., and each one of the defined radicals is assigned with a radical code from 0 to 763. These radical codes, together with the character type identification code "0", are systematically stored in the radical memory 21, as shown in FIG. 2, through a specific software program (not attached herewith). Since the strokes used in each radical are predetermined, it is best to store the sequential strokes with their related coordinates into the radical memory 21.

Figure 5:
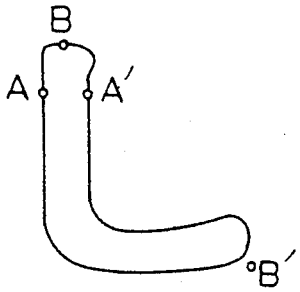

(4). Preparing a character pattern description table for Chinese characters (written in standard form) will now be described. Based upon the stroke table and the radical table as described and illustrated in FIGS. 3-1 to 3-20 and 4-1 to 4-10, any Chinese character can be easily arranged in a pattern description table, as shown in FIG. 5, wherein each character is assigned with an address for being used to indicate the position of the character in a memory unit, a radical set representing those portions of the character that can be isolated into radicals, and a stroke set representing those portions that cannot be defined as radicals. Each radical set has a radical code and each stroke set has a plurality of stroke codes. For example, the Chinese character " ", as shown in FIG. 5, has a character code 6639, a radical " " which has a radical code 18 (as shown in FIG. 4-1 of the radical table) and stroke codes 53, 47, 2, 10, 17, 17, and 4 (as respectively shown in Figs. 3-1 to 3-14 of the stroke table) wherein the radical " " can be further defined by strokes as shown in a', b', c' and d' with the corresponding stroke codes 45, 56, 54 and 77 respectively arranged in the stroke table. The character code, the radical codes and stroke codes representing the description of each character pattern is stored in the character pattern description memory 12 of the character generating apparatus, as shown in FIG. 2, through a software program (not attached herewith).

(5). Constructing the identification values for the variation parameters of the strokes and radicals for Chinese characters and other language characters will now be described with reference to FIGS. 6, 6-1 to 6-9 and 7-1 to 7-2. The stroke identification value can be from 0 to 240, the radical identification value from 255 and above without limiting upward optional expansion, and the variation parameter identification values from 241 (with the following parameters) to 254 (with the following parameters) wherein numeral 241 represents character height identification value, 242 represents character type identification value, 243 represents the stroke width identification value, 244 represents a ratio of height to width identification value, 245 represents special symbols identification value, etc. Moreover, the value of a character height can be set from 16 to 1024, meaning that the dot matrix forms of a character can be generated in dimensions from 16×16 to 1024×1024; the character types can have a maximum number up to 256 wherein "0" represents Sung-type characters, "1" represents slim stroke characters, "2" represents slim boldface stroke characters, "3" represents slim round stroke characters, "4" represents bulky stroke characters, "5" represents bulky boldface stroke characters, "6" represents bulky round stroke characters, "7" represents text-hand characters, "8" represents seal-type characters, "9" . . . with "256" in total. In addition, the value (243) of the stroke width can be set as "n" and n>0, representing "n" times of the stroke width defined by the width coordinates; the value (244) of a ratio of height to width is again set as "n" and n>0 where "n" may not be an integer; and the value (245) representing specific symbols can also be set from 0 to "n" wherein 0 represents letter A, 1 represents letter B . . . 25 represents letter Z, 26 represents small letter "a" . . . up to 245 by which any cursive Chinese characters and other language characters or letters can be defined with this identification value system for input into the character generating apparatus 10 in producing the required characters.

Referring to FIGS. 2, 2A and 2B, the process of character generation in high resolution is as follows:

When a character internal code, a character type code and an identification value (150) are input into the character generating apparatus 10 through the input means 15 and 105 of CPU-1 (the input means can be a keyboard or other input unit such as a mouse, a digitizer, etc.), data information is transferred from CPU-1 to CPU-2 where by using the character code as an index, CPU-2 can get the address of the input character from the internal code table memory 11 and retrieve the related character description information stored in the character pattern description memory 12 , and then, character description information (including radical code 13 and stroke code 14, together with specific symbol codes 29, variation parameters 30 and character type identification code 150 from input 15 of the CPU-1), are transferred to the stroke generating means 16 for further processing. It is to be noted that before the character internal code, character type code and identification values are transferred to CPU-2, all the above codes and values are temporarily stored in the input data latch 140, and, at the same time, a signal from CPU-1 is sent to CPU-2 (via the INT-72 path), indicating that the character internal code, character type code and identification values 150 (hereinafter referred to as "character data information") are already stored in the input data latch 140. It should be understood that before all the above character codes and values are transferred to the input data latch 140, CPU-1 will read in the one flag of the status data latch 6 via path L2-33 so as to see if the flag status of the second data latch 6 is at high level, which denotes that the second data latch 6 is available to store the data information; however, if the flag status of the status data latch 6 is at low level, it means that the last data information stored therein has not been read out by CPU-2 and no further data information can be stored. Therefore, CPU-1 must keep on detecting the flag condition of the status data latch 6 until the flag status thereof is at a high level indicating that the status data latch 6 is available, and then the flag will be automatically set to a low level after the CPU-1 writes the data information into input data latch 140.

Having found that the character data information is stored in the input data latch 140, CPU-2 starts to read the character data information from the input data latch 140 via a port enable signal R2-38, and, at the same time, sets the flag to a high level in the status data latch 6, indicating that the character data information is read out from the input data latch 140. After a complete character data information is fed into CPU-2, detailed processing will be made through the memory unit ROM-2 defined as stroke table memory 17, radial table memory 21 and specific symbol table memory 31, so as to respectively obtain the corresponding character description information including the corresponding coordinates of length, width and curvature 18, 19, 20 of the strokes from stroke table memory 17, the radical and stroke codes from radical table memory 21, and specific symbol codes, if any, from specific symbol table memory 31, and transfer them to stroke generator 16 from which stroke coordinates and variation values 22 of all strokes are therefore generated and transferred into the curve generator 23 (it should be understood that before the stroke coordinates and variation values 22 are transferred to curve generator 23, CPU-2 must detect for sure that the input buffer of the curve generator 23 is not occupied; otherwise, CPU-2 must keep on detecting until the curve generator 23 is in depletion condition ready to receive the information 22).

After curve generator 23 receives the stroke coordinates and variation values 22 of all strokes from CPU-2, it will immediately check whether or not the previous information processed therein is already completed (it shall be noted that, having received the stroke coordinates and variation values 22 from CPU-2, the curve generator 23 will immediately set a flag therein for indicating that its input buffer is fully occupied so as to prevent CPU-2 from inputting another stroke coordinates and variation values 22). If the previous data information (22) is completely processed, then it can accept the next stroke coordinates and variation values, and processing of the newly received data information (22) will begin; otherwise, curve generator 23 will continue its arithmetical operation of the previous data information until it is completed. After curve generator 23 has arithmetically completed a set of stroke coordinates and variation values, a VALID—57 will be set to 1 therein to indicate that its output buffer is ready to send out the processed stroke contour coordinates and, in the meantime, its internal processing operation will be temporarily held until the calculated stroke a contour coordinates are read out by filler 27 of CPU-2. After the stroke contour coordinates are read out, curve generator 23 will set VALID—57 =0 therein and continue its internal processing operation.

When filler 27 detects a high level condition of the VALID - 57 from curve generator 23, a REQ-51 signal (negative) will be sent out for reading in the stroke contour coordinates either in dot matrix form or in vector value form into RAM-1 to be read out in by CPU-1. On the other hand, the stroke contour coordinates in dot matrix form will be transferred to filler 27 for performing the blackening operation, and then, the blackened character pattern (in dot matrix) form is stored in the memory unit RAM-1 under the control of the multiplexer 9 to be output through the high resolution display unit 28 of the CPU-1 output device for producing resultant characters 33 and specific symbols 34. Moreover, the vector value stored in RAM-1 will be read out by CPU-1 and transferred to the high resolution plotter 25 of the CPU-1 output device for producing the resultant characters 26 and specific symbols 32 as shown in FIG. 2.

In the character generating operations as described and illustrated with reference to FIGS. 2, 2A and 2B, it is to be understood that there are three units which can access the RAM-1—1) the CPU-2 for storing vector value; 2) the filler 27 for storing the generated dot matrix; and 3) the CPU-1 for reading out the vector value or dot matrix information. The determination of which one among the three units to have the right to access RAM-1 is made through the Multiplexer 9 as controlled by two signals, MUXA-55 and MUXB-56, which are further controlled by CPU-2 by using I/O port decoder 4. Meanwhile, a holding signal will also be sent to filler 27 through I/0 port decoder 4 and the output data latch 5 via a path HOLD-8 58 for keeping filler 27 latched thereat so as to prevent the data information from getting lost therefrom.

Figure 6:
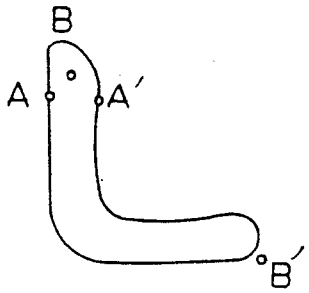
Figure 4:
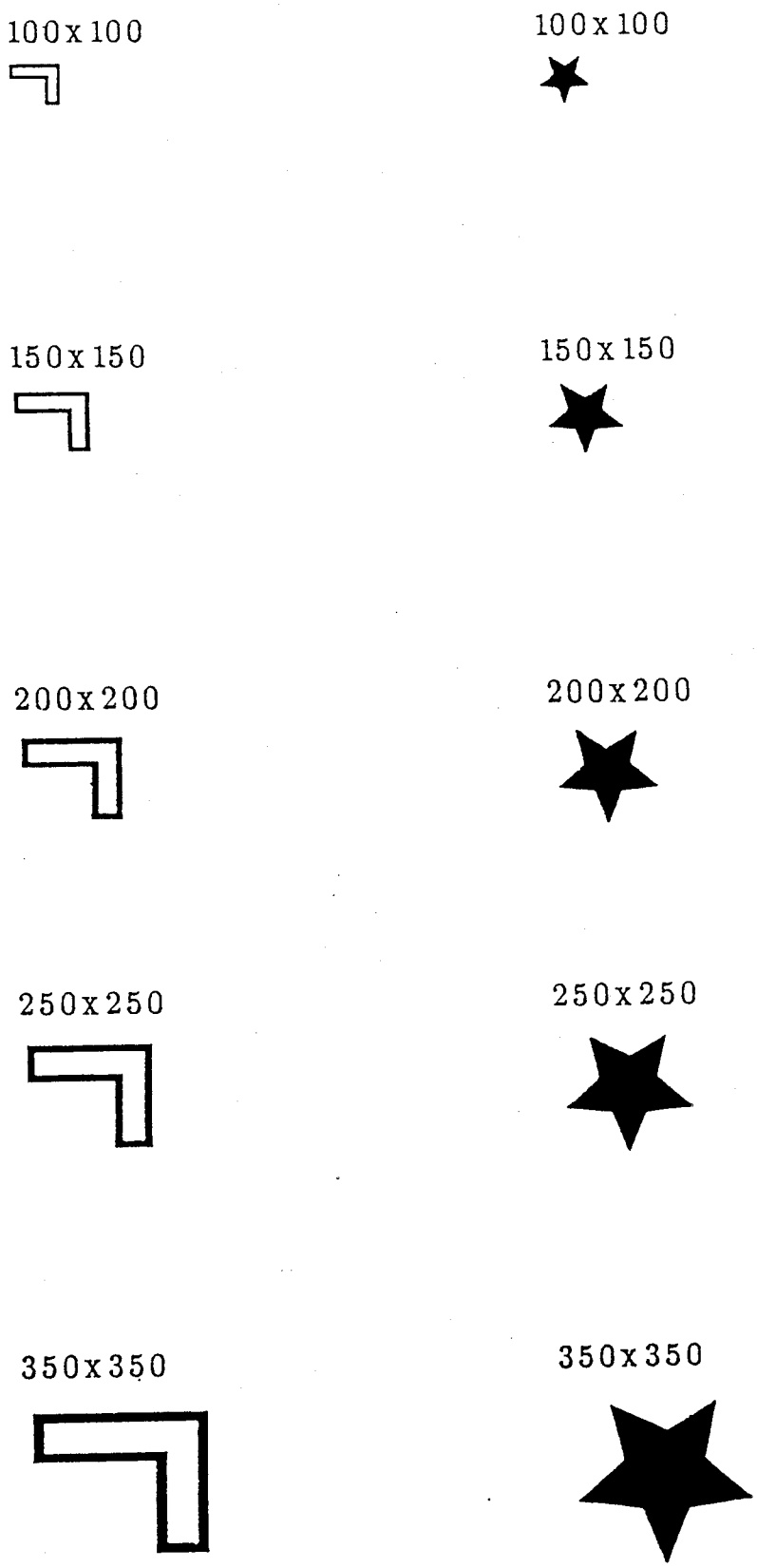
Figure 5:
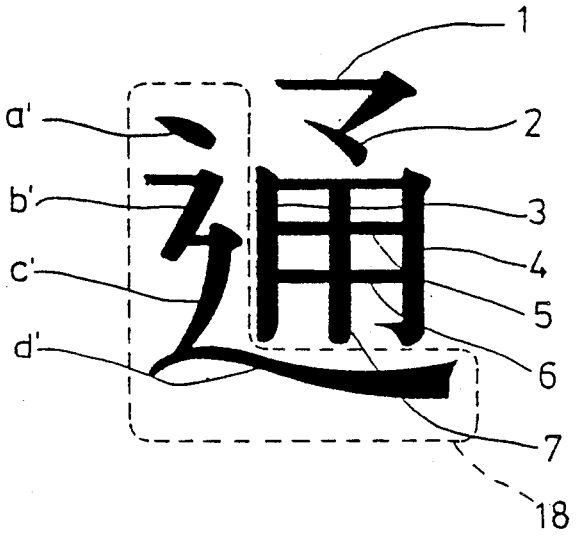
Figure 6:
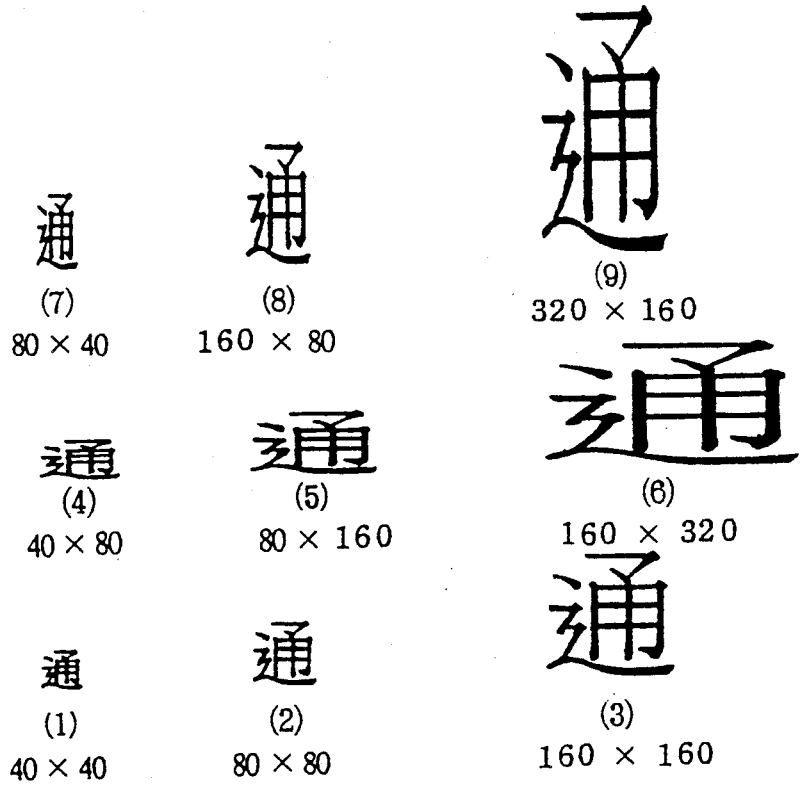
Figures 1, 2, 6:
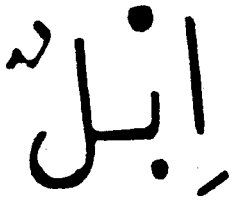

In the processing of character generation as described above, the filler 27 keeps on blackening the stroke contour one by one until all the stroke contours are completely blackened into the resultant dot matrix (or bit map) characters. On the other hand, after the completion of transferring the variation values 22 to curve generator 23, CPU-2 will keep on monitoring the arithmetical and blackening operations of both curve generator 23 and filler 27. Once the blackening operation is completed by filler 27 and CPU-2 has the stroke contour coordinates read into RAM-1, a signal from CPU-2 will be sent to CPU-1 through input data latch 140, indicating that the generated characters in dot matrix or vector value have been in RAM-1 and CPU-1 can now read the generated character information from RAM-1 through CPU data bus and address bus released by CPU-2. In the meantime, CPU-2 will also send a latching signal to filler 27 through output data latch 5 via HOLD-58 to lock out all operations of filler 27. Referring to FIGS. 3, 4, 5, 6 and 7, a Chinese character or other language letters can be obtained by inputting the character description information according to the stored tables and identification values. For example, as shown in FIGS. 5 and 6, the Chinese character "通" is obtained by inputting the character description information of a character code 6639, a character radical code 18 and stroke codes 53, 47, 2, 10, 17, 17, and 4 into the character generating apparatus 10 through the input means 15, 105. The character generating apparatus 10 will quickly process the input character code, variation parameters and identification values first through CPU-1 and then transferred to CPU-2 as described hereinbefore for producing the resultant character. As shown in FIG. 6, if parameters 24140 (241 is the height identification number and 40 is the height to width ratio of the character) and 2420 (242 is a character type identification code and 0 represents a Sung-type character) are also input, the corresponding coordinates of height, width, and curvature of each stroke with stroke codes 53, 47, 2, 10, 17, 17, 4 from stroke table memory 17 as well as the radical code 18 and stroke codes 45, 56, 54 and 77 from the radical table memory 21 will be fed into the stroke generator 16, producing the resulting character like the character "通" shown by (1) in FIG. 6 with a dimension of 40×40. By inputting different parameters of character height and height to width ratio, various patterns of a Chinese characters in different dimensions can be easily obtained as those shown by (2) to (9) in FIG. 6.

It is still to be noted that when a specific symbol and cursive Chinese characters or other language characters or letters such as those shown in FIGS. 4, 6-1 to 6-9 and 7-1 to 7-2 are to be generated by the method and apparatus of this invention, the process is the same as when processing an ordinary Chinese character except that specific symbol identification code 29, variation parameter 30 and specific symbol code are input through input 15. In this condition, CPU-2 will process all the related information through the specific symbol table memory 31 and the stroke generator 16 , as shown in FIG. 2, for generating the resultant cursive Chinese characters "学" and "逆" as shown in FIGS. 7-1, other language letters shown in FIGS. 6-1 to 6-9 and 7-2, and the special symbols as shown in FIG. 4 in high resolution.

It can be appreciated that the character generation method and apparatus of this invention indeed provides a valuable solution for processing the Chinese characters, and other language letters and specific symbols. No matter how the characters, letters and specific symbols are changed in their pattern, each character, letter and specific symbol stored in the memory units of the character generating apparatus 10 ordinarily occupies 64 bytes. In addition, since all the stored description information of characters, letters and specific symbols are treated as graphs by the method and apparatus of this invention, both the characters and the graphic information can be handled quickly and simultaneously. the invention treats all the stored characters, letters and spicific symbols as a graph, it is thereofr very fast in handling both the charactes and the graphic information at the same time.

Although the method and apparatus for high resolution character generation of the present invention have been described by way of preferred embodiment, it is to be noted that changes and modifications made by those skilled in the art are still possible without departing from the scope and spirit of the present invention.

What is claimed is:

1. A method for storing Chinese character description information for use in a character generating apparatus, said method comprising the steps of:

(1) constructing a stroke table for Chinese characters having a character type identification code designated thereto, and each stroke of the characters for each character type identification code being defined by coordinates of stroke height, width and curvature points for providing stroke description information therewith and having a stroke code associated with each stroke, said character type identification code, said stroke codes and said coordinates being systematically stored in a stroke table memory of said character generating apparatus through a software program, (2) constructing a character radical table for Chinese characters having a character type identification code designated thereto and a plurality of common radicals defined therewith, each radical being assigned a radical code and stroke codes defining the strokes making up each radical in the radical table; said character type identification code and said radical and stroke codes being systematically stored in a radical table memory of said character generating apparatus through a software program;

(3) preparing character pattern description information for Chinese characters, each character including a character code, a character radical code based on said character radical table, and stroke codes based on said stroke table; said character code, character radical code, and stroke codes being systematically stored in a character pattern description memory of said character generating apparatus through a software program; and (4) constructing identification values for variation parameters which control the width of strokes stored in said stroke table and the size of radicals stored in said radical table of Chinese characters for input into said character generating apparatus to produce required characters; so that characters in different patterns can be quickly produced in high resolution.

2. A method according to claim 1 wherein said step of constructing identification values for variation parameters of strokes and radicals of Chinese characters further comprises the step of defining a character height and width identification value, a character type identification value, a stroke width identification value, a ratio of character height to width identification value, and a special symbol identification value, so that, various dimensions of characters can be produced in high resolution.

3. A method as claimed in claim 1 wherein said step of constructing identification values for variation parameters of strokes and radicals of Chinese characters further comprises the step of defining character dimensions from $16\times16$ up to $1024\times1024$ dot matrix forms.

* * * * *